US007712883B2

(12) United States Patent
Studer

(10) Patent No.: US 7,712,883 B2
(45) Date of Patent: May 11, 2010

(54) PRINT CARTRIDGE BODY

(75) Inventor: Anthony D. Studer, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 858 days.

(21) Appl. No.: 11/493,336

(22) Filed: Jul. 26, 2006

(65) Prior Publication Data

US 2008/0024570 A1 Jan. 31, 2008

(51) Int. Cl.
*B41J 2/175* (2006.01)

(52) U.S. Cl. ..... 347/87

(58) Field of Classification Search ..... 347/86, 347/87

See application file for complete search history.

(56) References Cited

U.S. PATENT DOCUMENTS

| | | | | |
|---|---|---|---|---|
| 4,436,439 | A | 3/1984 | Koto | |
| 4,771,295 | A | 9/1988 | Baker et al. | |
| 4,812,859 | A * | 3/1989 | Chan et al. | 347/63 |
| 5,025,271 | A * | 6/1991 | Baker et al. | 347/87 |
| 5,497,178 | A | 3/1996 | DeFosse et al. | |
| 5,576,750 | A | 11/1996 | Brandon et al. | |
| 5,602,574 | A | 2/1997 | Williams | |
| 5,659,345 | A | 8/1997 | Altendorf | |
| 5,926,195 | A | 7/1999 | Domhoff et al. | |
| 6,015,211 | A | 1/2000 | Kinoshita et al. | |
| 6,042,225 | A * | 3/2000 | Altendorf et al. | 347/87 |
| 6,206,513 | B1 * | 3/2001 | Tajima et al. | 347/86 |
| 6,260,961 | B1 | 7/2001 | Seu et al. | |
| 6,578,942 | B1 | 6/2003 | Tuhro et al. | |
| 6,796,651 | B2 | 9/2004 | Silverbrook et al. | |
| 6,951,390 | B2 | 10/2005 | King et al. | |
| 6,974,212 | B2 | 12/2005 | Silverbrook et al. | |
| 6,980,235 | B1 | 12/2005 | Yamamoto et al. | |
| 6,981,765 | B2 | 1/2006 | King et al. | |
| 6,986,573 | B2 | 1/2006 | Silverbrook et al. | |
| 6,991,332 | B1 | 1/2006 | Fan et al. | |
| 2005/0024450 | A1 | 2/2005 | Seu | |
| 2005/0140761 | A1 | 6/2005 | Amma et al. | |
| 2005/0200688 | A1 | 9/2005 | Silverbrook et al. | |
| 2006/0092245 | A1 | 5/2006 | Stellbrink | |

OTHER PUBLICATIONS

PCT Invitation to Pay Additional Fees and Partial International Search Report for patent application No. PCT/US2007/074314.

* cited by examiner

*Primary Examiner*—Anh T. N. Vo

(57) ABSTRACT

An embodiment provides a print cartridge body with three or more compartments in series, and a partition formed between each successive pair of compartments. Each partition is substantially parallel to a scanning direction of the cartridge body.

20 Claims, 14 Drawing Sheets

PRINT CARTRIDGE BODY

BACKGROUND

Multicolored ink-jet cartridges usually include a body having a plurality of ink reservoirs, each for containing different colored ink, and a print head having a print head die with a plurality of slots communicatively coupled to the plurality of ink reservoirs via an ink-delivery manifold. Ink-delivery manifolds increase the size of ink-jet cartridges. This is a problem, especially for applications involving ink-jet cartridges having smaller form factors. Ink delivery manifolds may increase the number and complexity of the process steps used to manufacture ink-j et cartridges and thus the cost of the ink-jet cartridges. Moreover, the body of some ink-jet cartridges is formed as a one-piece injection-molded part and may involve using one or more mold-slide inserts for forming channels in an ink-delivery manifold. Each mold-slide insert leaves behind one or more openings (or mold-slide-insert access holes) in the cartridge body. One or more plugs subsequently seal each mold-slide-insert access hole. The use of a plug and mold-slide-inserts can be costly from a manufacturing standpoint.

DETAILED DESCRIPTION

In the following detailed description of the present embodiments, reference is made to the accompanying drawings that form a part hereof, and in which are shown by way of illustration specific embodiments that may be practiced. These embodiments are described in sufficient detail to enable those skilled in the art to practice disclosed subject matter, and it is to be understood that other embodiments may be utilized and that process, electrical or mechanical changes may be made without departing from the scope of the claimed subject matter. The following detailed description is, therefore, not to be taken in a limiting sense, and the scope of the claimed subject matter is defined only by the appended claims and equivalents thereof.

Figure 1:
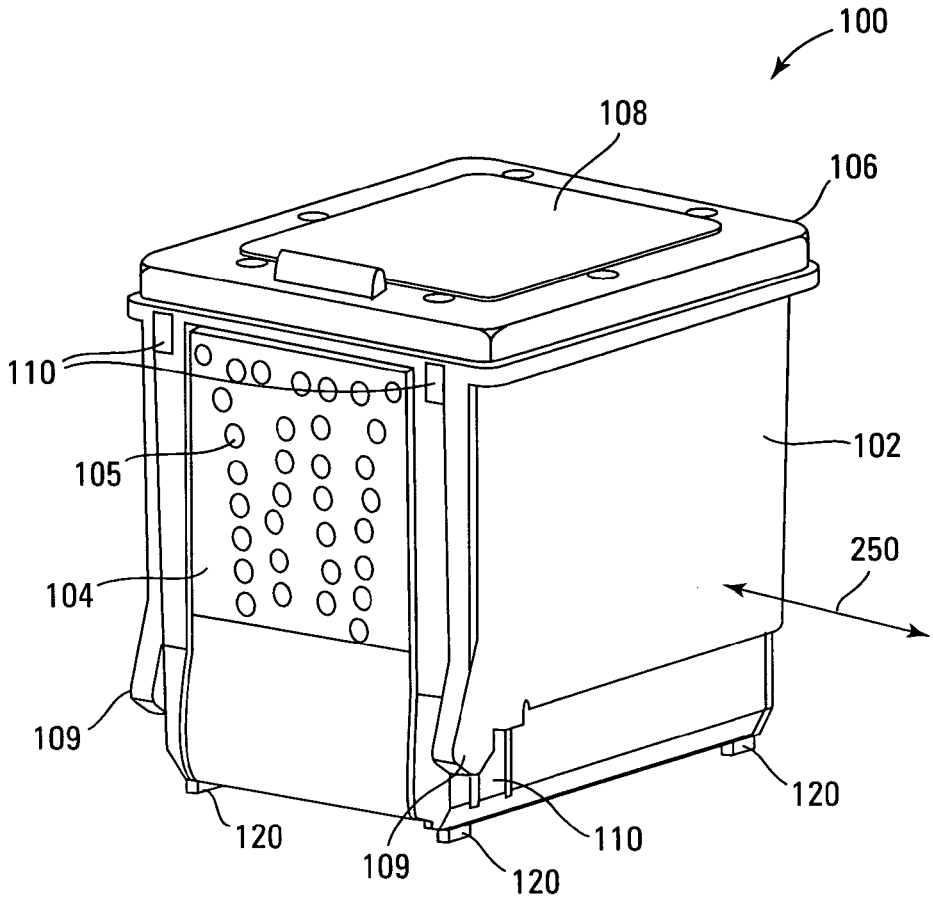
FIG. 1 is a three-dimensional representation of an embodiment of a print cartridge, according to an embodiment of the present invention.

FIG. 1 is a three-dimensional representation of a print (or ink-jet) cartridge 100, according to an embodiment. For one embodiment, ink-jet cartridge 100 may be a multi-colored, e.g., two or more colors, or a single-colored, e.g., black, ink-jet cartridge. For another embodiment, ink-jet cartridge 100 may be used in various imaging devices, such as facsimile machines, desktop printers, manual hand-held printers, etc. Ink-jet cartridge 100 includes a cartridge body 102. A head assembly 104, such as a Tab-Head-Assembly (THA), is attached to cartridge body 102. For one embodiment, head assembly 104 includes flexible circuit and a print head die with an orifice plate (not shown in FIG. 1), as is known by those of skill in the art. Head assembly 104 includes a plurality of interconnect pads 105 for coupling the flexible circuit to a printer controller. A cover 106 closes one or more ink compartments formed in body 102. For one embodiment, one or more vent channels are formed in cover 106 that communicate with the ink compartments, as is known in the art. For another embodiment, a vent label 108 is adhered to cover 106 and overlies at least a portion of the vent channels.

For one embodiment, alignment lugs 109 are optionally formed on cartridge body 102 to facilitate installation in a printer. For another embodiment, elimination of alignment lugs 109 eliminates a need for using a front mold slide during manufacture. For another embodiment, zero draft surfaces 110 are formed in cartridge body 102 and are used for assembly registration to tooling and alignment in a printer. For another embodiment, a plurality of legs 120 extends from a bottom of cartridge body 102. Legs 120 provide clearance between the bottom cartridge body 102 and a surface on which ink-jet cartridge 100 may be located for protecting the print head die located at the bottom of cartridge body 102. Alternatively, legs 120 may be unitary structures, such as ribs extending from the bottom of cartridge body 102.

Figure 2:
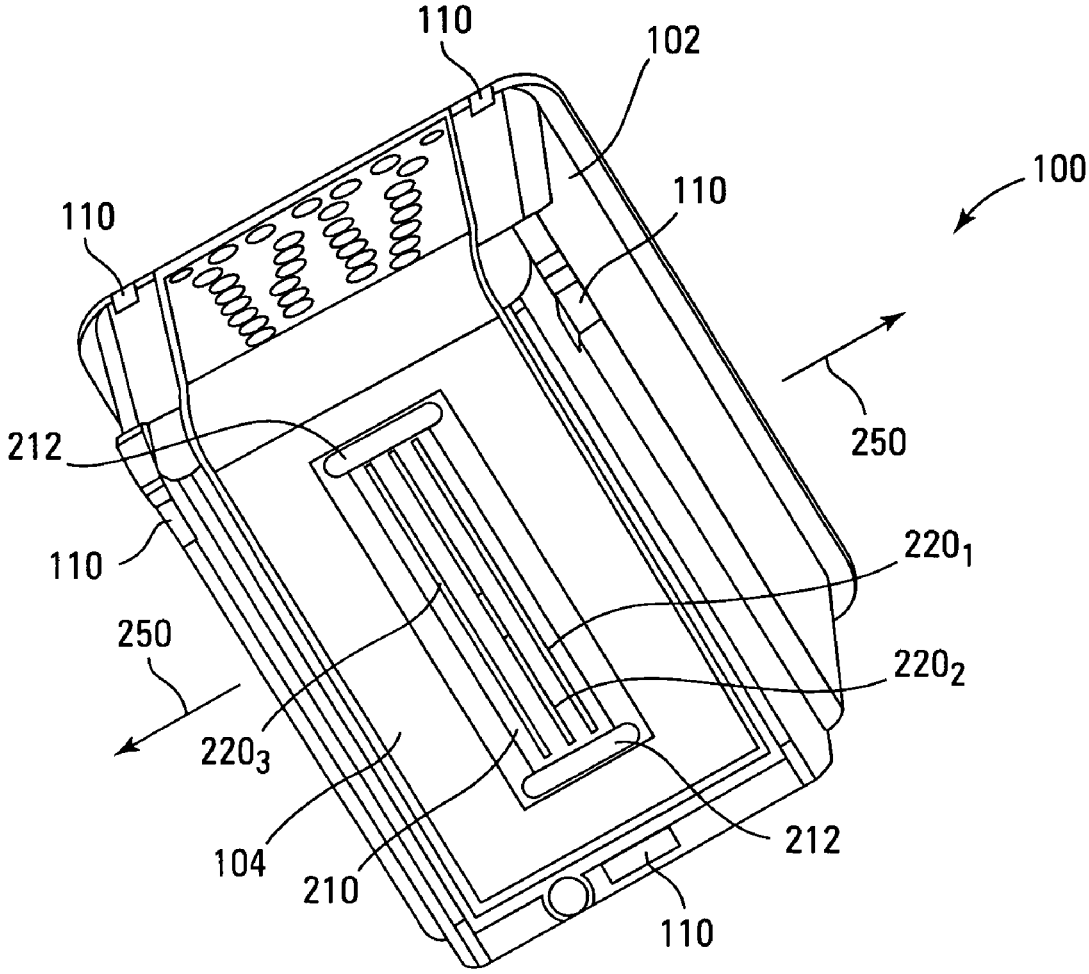
FIG. 2 is a three-dimensional representation of an embodiment of a print cartridge, viewed from the bottom, according to another embodiment of the present invention.

FIG. 2 is a three-dimensional representation of ink-jet cartridge 100, viewed from the bottom, according to another embodiment. The ink-jet cartridge 100 of FIG. 2 is configured as a multi-colored ink-jet cartridge, e.g., a tri-colored ink-jet cartridge. Head assembly 104 includes a print head die 210 with the orifice plate removed. An encapsulant 212 encapsulates a plurality of electrical interconnects that interconnect the flexible circuit of head assembly 104 to electrical contacts of print head die 210. For one embodiment, the electrical contacts of print head die 210 selectively supply electrical power to a plurality of resistors or piezoelectric devices that are used to expel ink from print head die 210. A plurality of slots 220 is formed in print head die 210. Slots 220 are communicatively (or fluidly) coupled to the ink compartments within cartridge body 102 and receive ink from the ink compartments and deliver it to orifices in the orifice plate.

Note that the bottom of ink-jet cartridge 100 is substantially one plane and is not stepped as is common for many conventional ink-jet cartridges. That is, ink-jet cartridge 100 has a substantially rectangular (or square for some embodiments) profile when viewed along a direction parallel to a scanning direction (indicated by arrows 250 in FIGS. 1 and 2) of ink-jet cartridge 100 during printing. This acts to reduce the complexity of the ink-delivery channels for delivering ink to print head die 210 and to eliminate the need for an ink-delivery manifold and thereby acts to reduce manufacturing time and thus costs. In addition, the bottom of ink-jet cartridge 100 being substantially one plane provides for a longer print head die, in a direction perpendicular to scanning direction 250, relative to a length of the ink-jet cartridge in the direction perpendicular to scanning direction 250, thus enabling a longer print swath.

Figure 3:
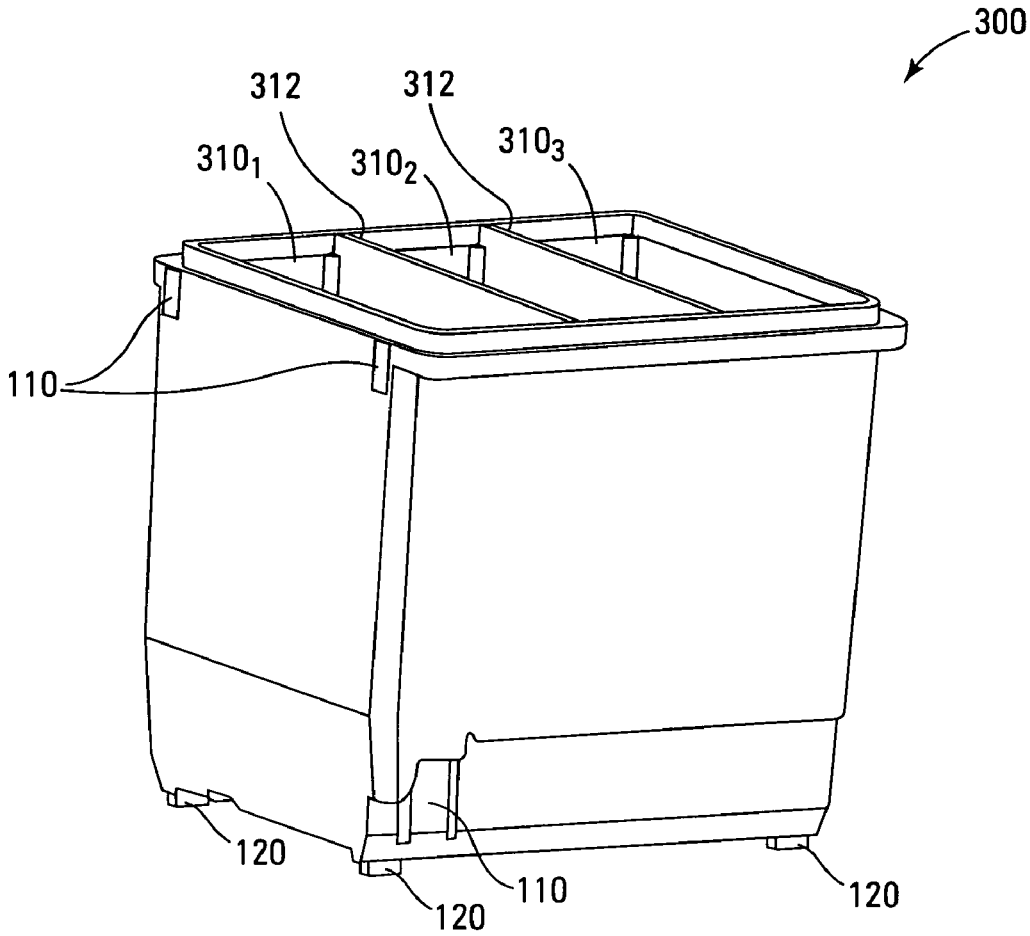
FIG. 3 is a three-dimensional representation of an embodiment of a cartridge body, according to another embodiment of the present invention.

FIG. 3 is a three-dimensional representation of a cartridge body 300, e.g., that can be used as the cartridge body of ink-jet cartridge 100 of FIGS. 1 and 2, according to another embodiment. Common reference numbers denote similar elements in FIGS. 1-3. For one embodiment, cartridge body 300 includes a plurality of compartments 310 for containing different colored inks, such as red, blue, and green, magenta, yellow, and cyan, etc. Partitions 312 are disposed in the interior of cartridge body 300 to separate compartments 310 from each other, and thereby form compartments 310. For one embodiment, compartments 310 have substantially equal volumes.

Figure 4:
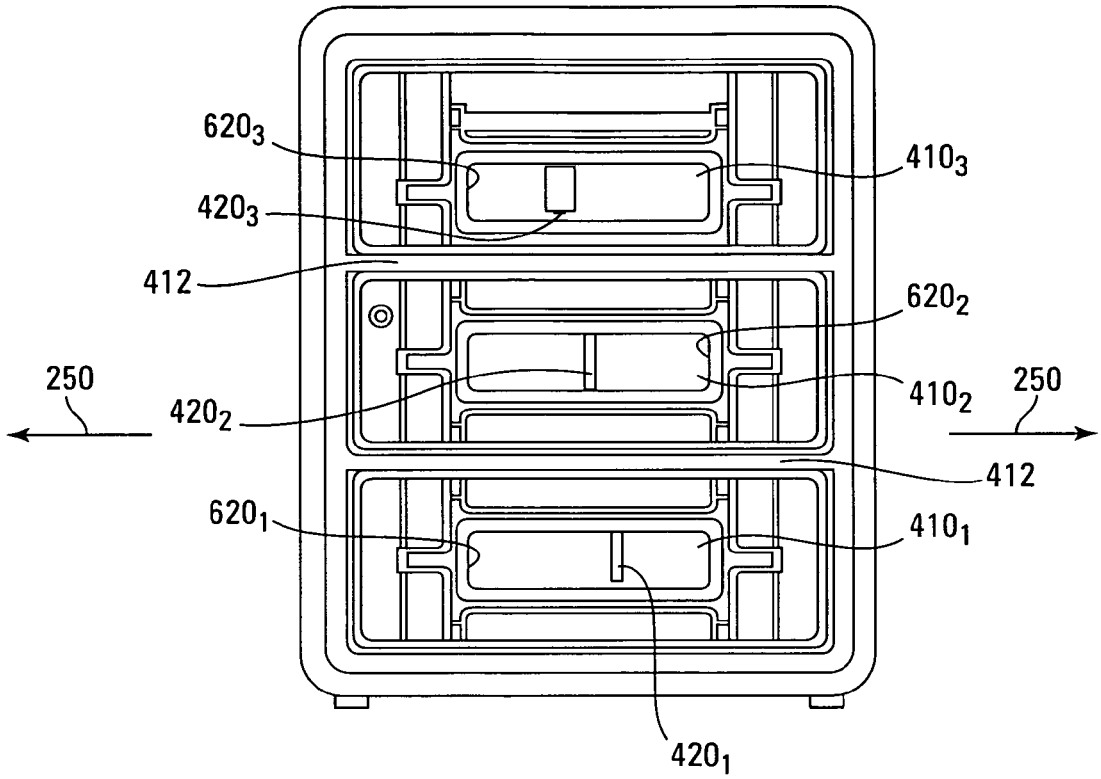
FIG. 4 is a top view of an embodiment of a cartridge body, according to another embodiment of the present invention.

FIG. 4 is a top view of a cartridge body, such as cartridge body 102 of FIGS. 1 and 2 or cartridge body 300 of FIG. 3, according to another embodiment. The cartridge body includes a plurality of compartments 410 for containing different colored inks. Outlet ports 4201-4203 are respectively formed at the bottoms of compartments 4101-4103. Note that compartments 410 are in series along a direction perpendicular to the scanning direction 250. Alternatively, partitions 412 disposed in an interior of the cartridge body and that separate compartments 410 from each other are substantially parallel to the scanning direction 250. For one embodiment, a capillary medium, such as foam, may be disposed in each of compartments 410 for exerting a capillary force on the ink that acts to prevent the ink from leaking. Alternatively, other suitable backpressure generating mechanisms may be used in the cartridge, such as free-ink spring-bag, bellows systems, etc., to prevent the ink from leaking.

Figure 5:
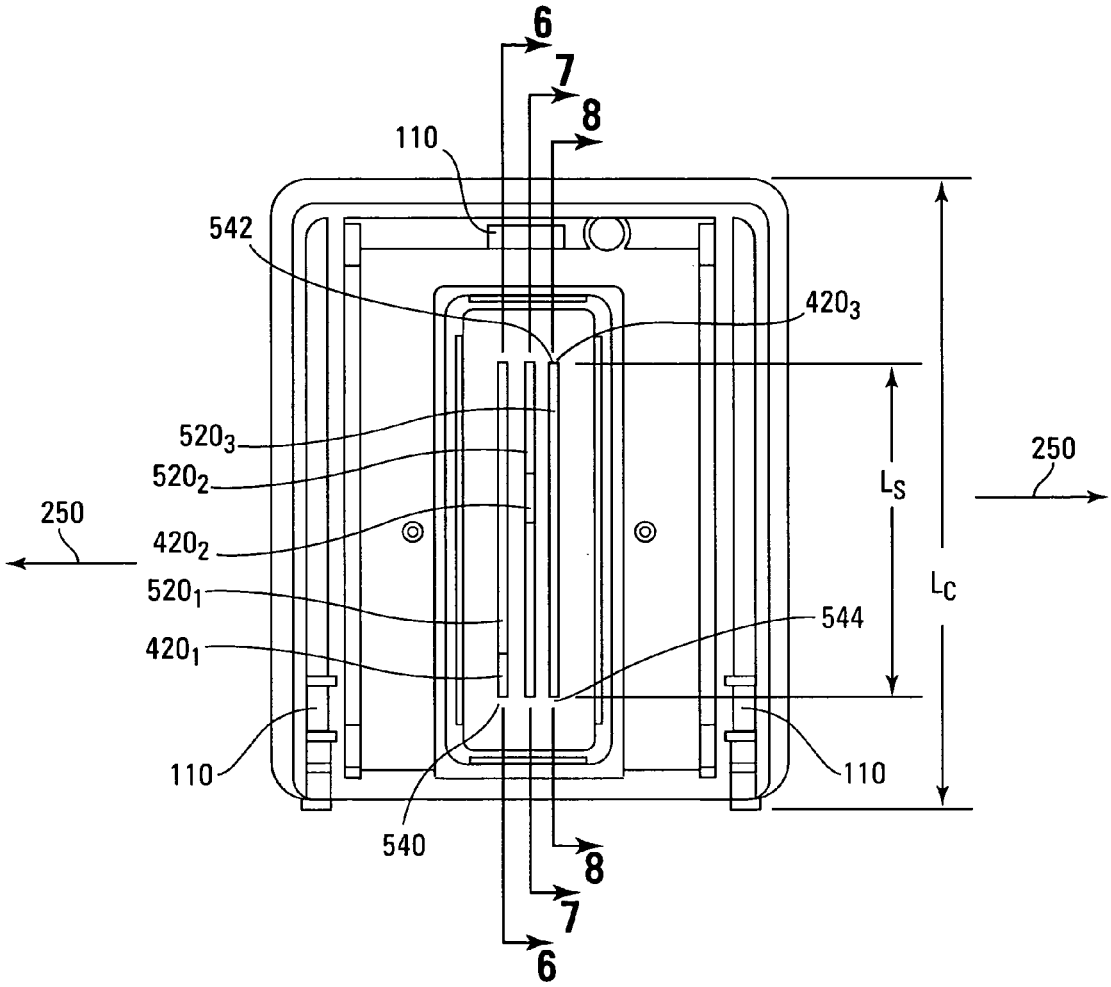
FIG. 5 is a bottom view of an embodiment of a cartridge body, according to another embodiment of the present invention.

FIG. 5 is a bottom view of the cartridge body of FIG. 4, according to another embodiment. Common reference numbers denote similar elements in FIGS. 1-3 and FIG. 5. The cartridge body includes a plurality of ink-feed channels 520 that are communicatively coupled to outlet ports 420. In other words, outlet ports 420 open into ink-feed channels 520. Ink-feed channels 520 open directly to an exterior of the cartridge body and communicatively couple compartments 410 to the exterior of the cartridge body. Ink-feed channels 520 are configured to respectively align with slots in the print head die, such as slots 220 of print head die 210 of FIG. 2, for delivering ink thereto. For one embodiment, portions of the bottom of the cartridge body surrounding ink-feed channels 520 are attached directly to portions of the print head die that surround the slots of the print head die, e.g., using an adhesive or encapsulant. For example, the portions of the bottom of the cartridge body surrounding ink-feed channels 520 may be attached directly to portions of print head die 210 of FIG. 2 that surround slots 220 of print head die 210 on a side opposite to that shown in FIG. 2. In operation, ink flows from compartments 410 (FIG. 4), through outlet ports 420 (FIGS. 4 and 5), into ink-feed channels 520 (FIG. 5), and subsequently into slots 220 of print head die 210 (FIG. 2), for example. It should be noted that although generally square or rectangular outlet ports 420 are shown, they could be other shapes such as circles, slots, etc. Additionally, ink-feed channels 520 could be other shapes, sizes or eliminated altogether. For embodiments where ink-feed channels 520 are eliminated, outlet ports 420 open directly into slots of a print head die, such as slots 220 of print head die 210 (FIG. 2).

For one embodiment, a ratio of the length $L_C$ (FIG. 5) of the cartridge body perpendicular to the scanning direction 250 to a length $L_S$ of ink-feed channels 520 and/or a length of slots of a print head die, such as slots 220 of print head die 210 (FIG. 2) perpendicular to the scanning direction 250 is less than about 2. In other words, length $L_S$ of ink-feed channels 520 and/or of the slots 220 of print head die 210 are greater than about ½ the length $L_C$ of the cartridge body. The ratio of the length of a conventional cartridge body perpendicular to its scanning direction to a length of ink-feed channels of the conventional cartridge body or the slots of a print head die coupled to a conventional cartridge body is greater than about 3. In other words, the ink-feed slots in the die and/or channels of conventional cartridge bodies are typically less than about ⅓ of the length of the cartridge body. A ratio of the length $L_C$ of the cartridge body to the length $L_S$ of ink-feed channels 520 less than about 2 eliminates the need for an ink-delivery manifold and thereby acts to reduce manufacturing time and the part count and thus costs.

Figure 6:
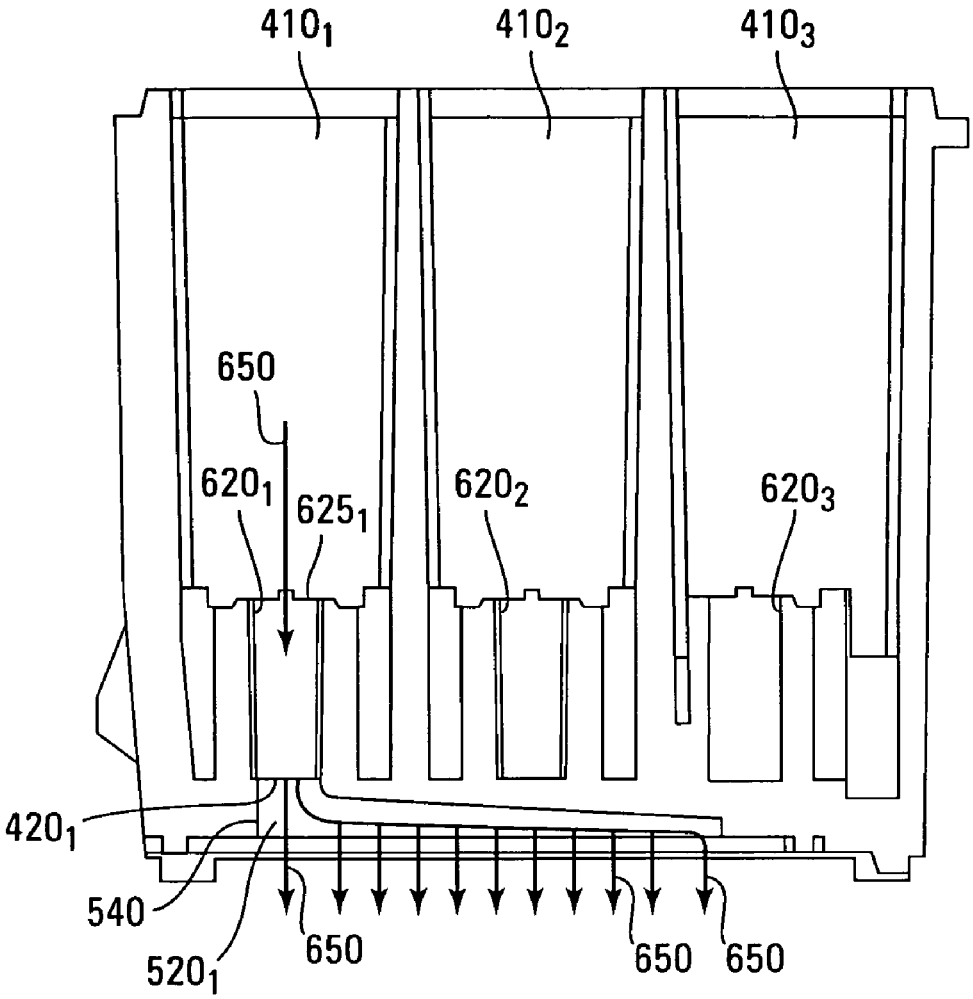
FIGS. 6, 7, and 8 are cross-sectional views respectively taken along lines 6-6, 7-7, and 8-8 of FIG. 5, according to another embodiment of the present invention.
Figure 7:
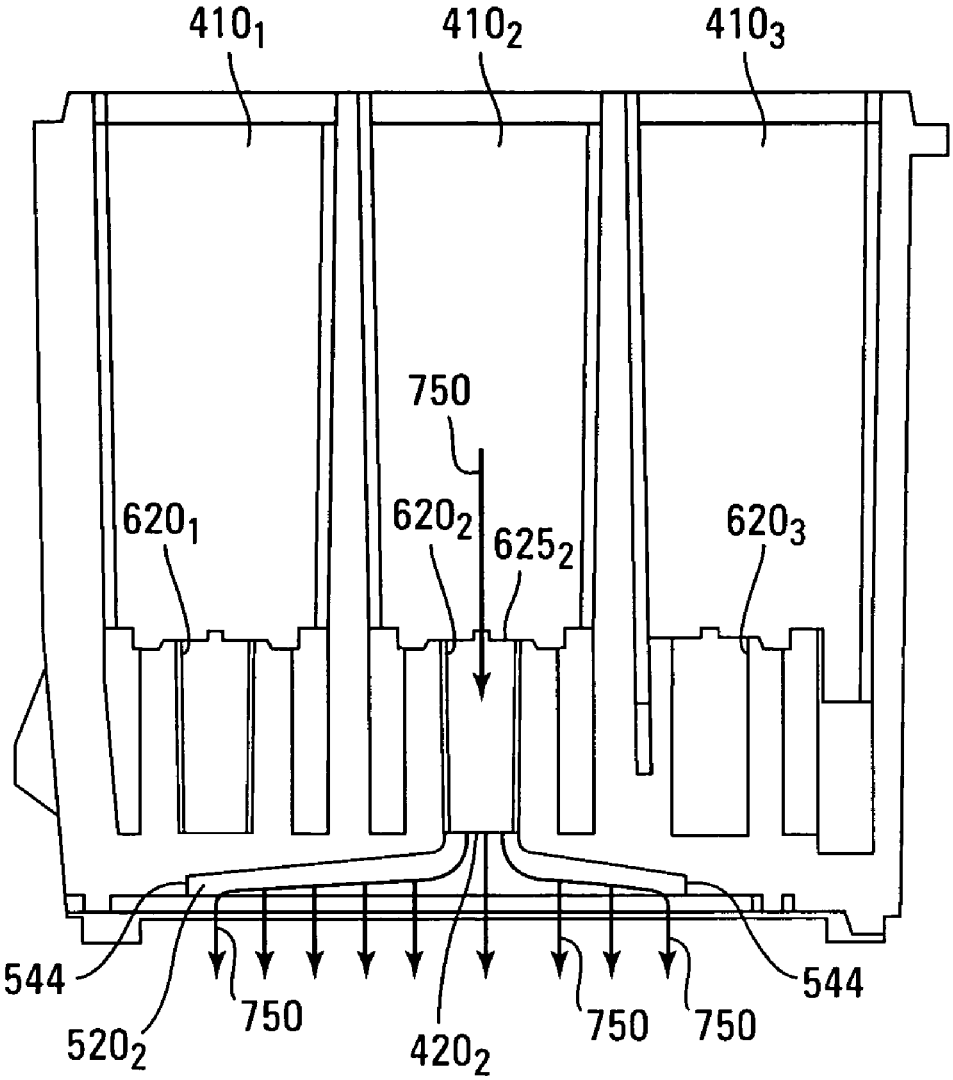
Figure 8:
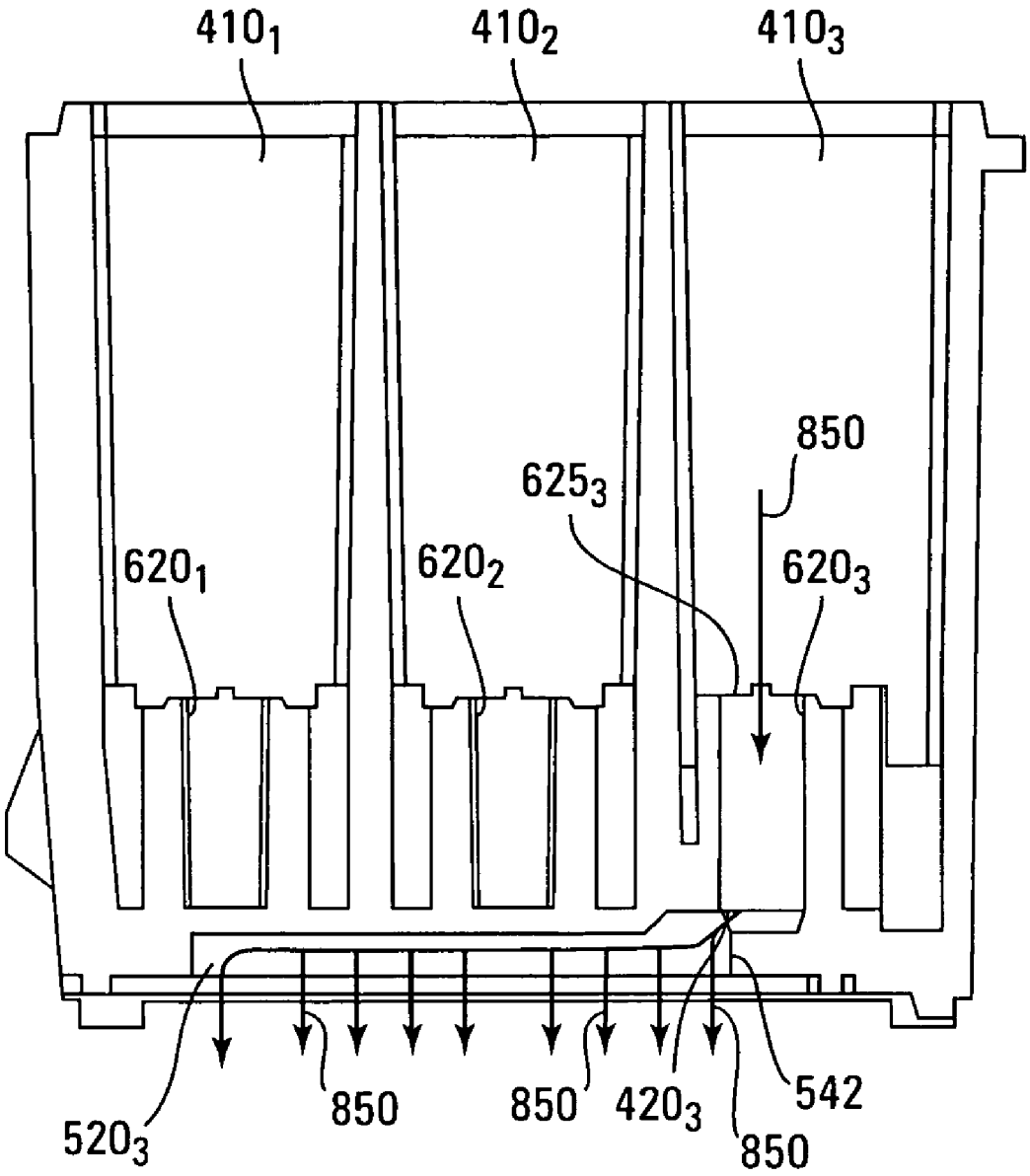

FIGS. 6, 7, and 8 are cross-sectional views respectively taken along lines 6-6, 7-7, and 8-8 of FIG. 5, according to another embodiment. In one embodiment, a duct (or standpipe) 620 (see also FIG. 4) is located within each compartment 410 and is connected (or opens) to an outlet port 420, as shown in FIGS. 6, 7, and 8. Outlet ports 420 open into ink-feed channels 520. For another embodiment, a filter may be located over an inlet 625 (FIGS. 6, 7, and 8) of each of ducts 620. For one embodiment, the capillary material overlies the filter.

Arrows 650 (FIG. 6) illustrate a flow path of ink from compartment $\mathbf{410}_1$ through duct $\mathbf{620}_1$, through outlet port $\mathbf{420}_1$, and into ink-feed channel $\mathbf{520}_1$. Note that ink-feed channel $\mathbf{520}_1$ acts as a channel expansion, and the ink-flow expands as it passes substantially vertically downward through outlet port $\mathbf{420}_1$ and into ink-feed channel $\mathbf{520}_1$. As the ink-flow expands to fill ink-feed channel $\mathbf{520}_1$, it flows substantially horizontally and substantially perpendicular to the scanning direction, which is perpendicular to the plane of FIG. 6.

Arrows 750 (FIG. 7) illustrate a flow path of ink from compartment $\mathbf{410}_2$ through duct $\mathbf{620}_2$, through outlet port $\mathbf{420}_2$, and into ink-feed channel $\mathbf{520}_2$. Note that ink-feed channel $\mathbf{520}_2$ acts as a channel expansion, and the ink-flow expands as it passes substantially vertically downward through outlet port $\mathbf{420}_2$ and into ink-feed channel $\mathbf{520}_2$. As the ink-flow expands to fill ink-feed channel $\mathbf{520}_1$, it bifurcates and flows in opposite directions, each substantially horizontally and substantially perpendicular to the scanning direction, which is perpendicular to the plane of FIG. 7.

Arrows 850 (FIG. 8) illustrate a flow path of ink from compartment $\mathbf{410}_3$ through duct $\mathbf{620}_3$, through outlet port $\mathbf{420}_3$, and into ink-feed channel $\mathbf{520}_3$. The ink-flow exits outlet port $\mathbf{420}_3$ parallel to a normal to a plane of outlet port $\mathbf{420}_3$ at an angle to the vertical, and thus at outlet port $\mathbf{420}_3$, the ink-flow and the normal to the plane of outlet port $\mathbf{420}_3$ has a vertically downward directed component and a horizontal component substantially perpendicular to the scanning direction, which is perpendicular to the plane of FIG. 8. After exiting outlet port $\mathbf{420}_3$, the ink-flow flows substantially horizontally and substantially perpendicular to the scanning direction to fill ink-feed channel $\mathbf{520}_3$.

With reference to FIGS. 5 and 6, it is seen that for one embodiment, outlet port $\mathbf{420}_1$ may extend over a portion of the length of ink-feed channel $\mathbf{520}_1$ in a direction perpendicular to scanning direction 250, starting at an end 540 of ink-feed channel $\mathbf{520}_1$. FIGS. 5 and 8 illustrate that a portion of outlet port $\mathbf{420}_3$ may extend past an end 542 of ink-feed channel $520_3$, and a remaining portion may extend into ink-feed channel $520_3$. FIGS. 5 and 7 illustrate that outlet port $420_2$ may be located away from ends 544 of ink-feed channel $520_2$.

Note that the cartridge body of FIGS. 4-8 and ink-feed channels 520 thereof are formed as single-piece and form a unitary structure. Attaching a print head nozzle array, such as print head die 210 of FIG. 2, seals ink-feed channels 520 to the corresponding slots 220 in the print head die.

Figure 9:
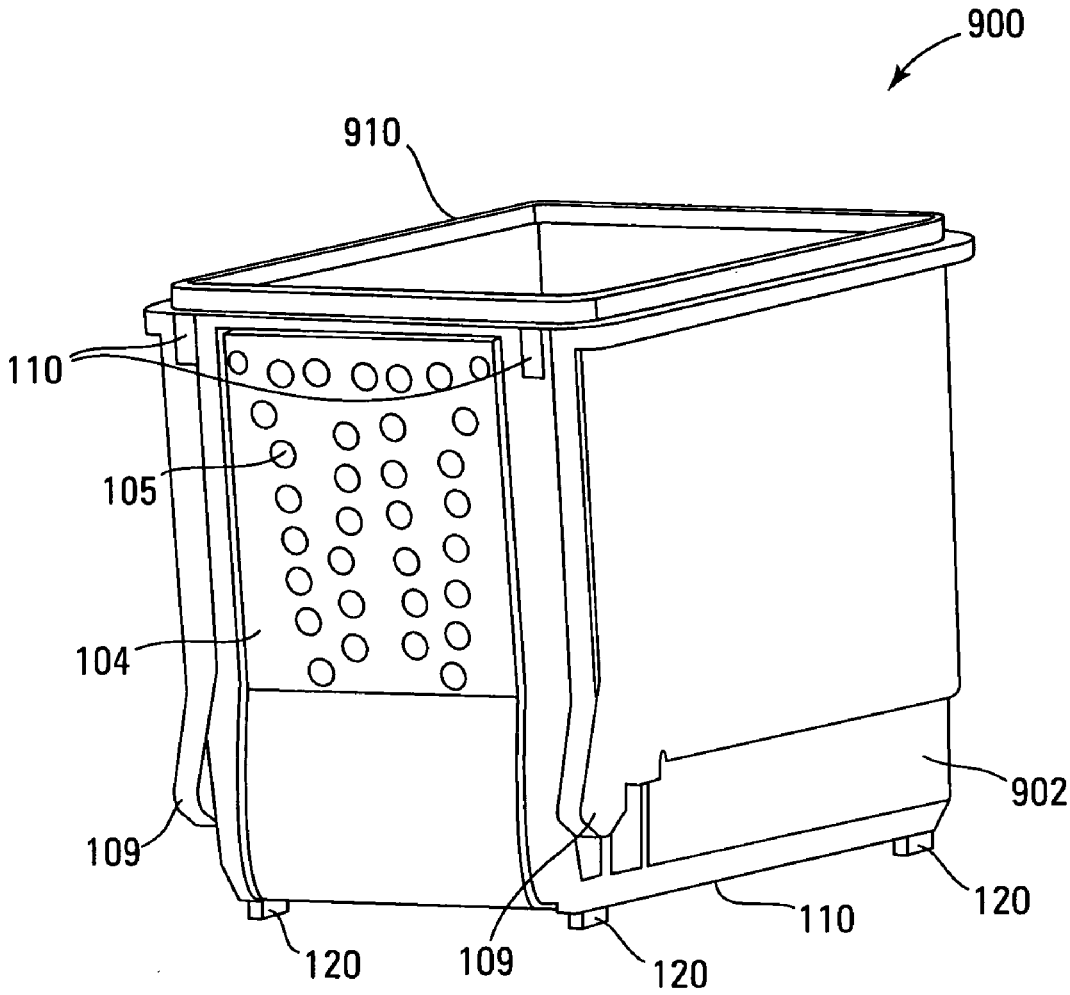
FIG. 9 is a three-dimensional representation of an embodiment of a single-colored print cartridge, according to another embodiment of the present invention.

FIG. 9 is a three-dimensional representation of a single-colored, e.g., black, print (or ink-jet) cartridge 900, according to another embodiment. Ink-jet cartridge 900 includes a cartridge body 902. Common reference numbers denote similar elements in FIGS. 1 and 2 and FIG. 9. Cartridge body 902 includes a single compartment 910 for containing ink. For one embodiment, the cover 106 of the ink-jet cartridge 100 of FIG. 1 may be used to close compartment 910. This means that for some embodiments cover 106 can be used for both the three-compartment cartridge body 300 of FIG. 3 and the single-compartment cartridge body 902 of FIG. 9. Moreover, for one embodiment, essentially the same molding process used for cartridge body 102 (FIG. 1) or cartridge body 300 (FIG. 3), but with a different mold core for forming the interior, may form cartridge body 902.

Figure 10:
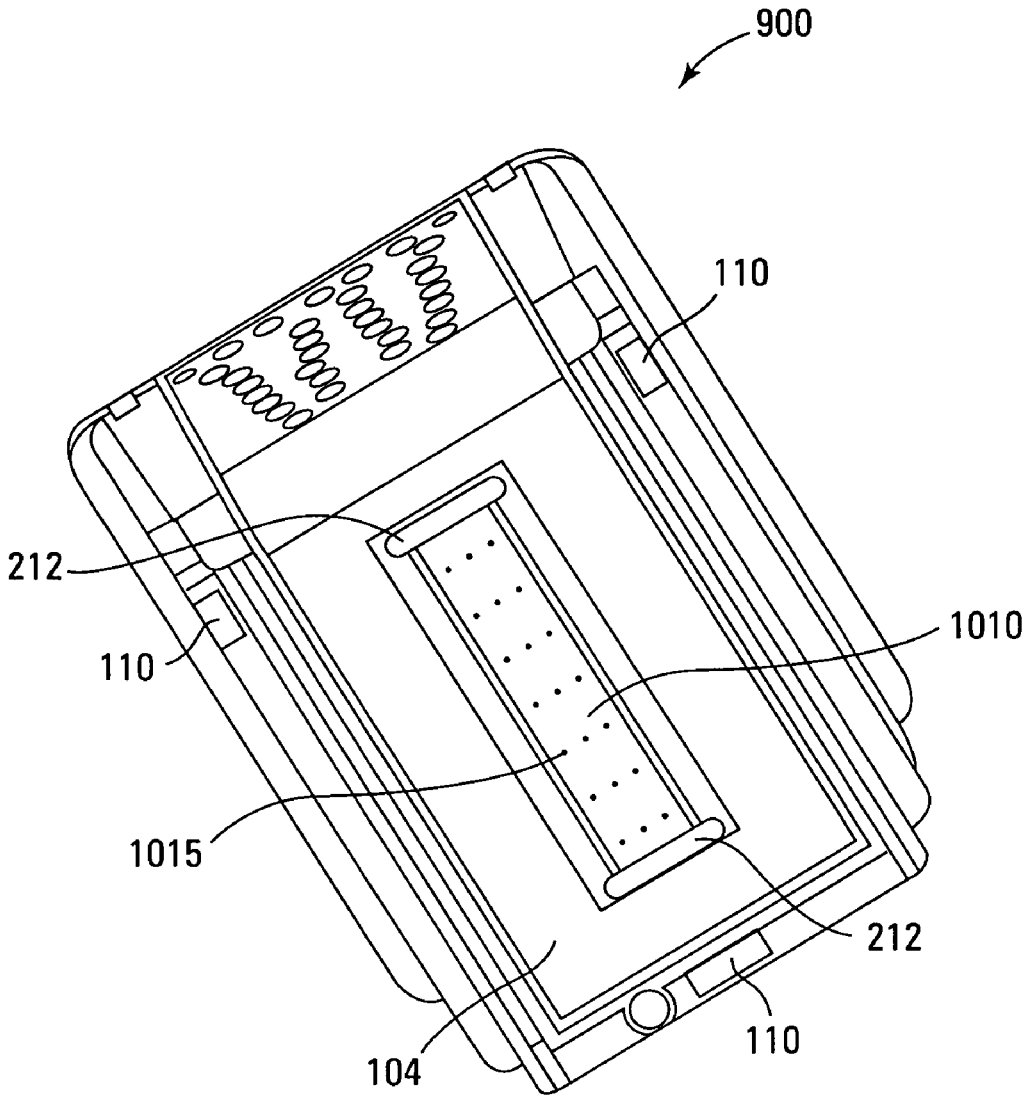
FIG. 10 is a three-dimensional representation of an embodiment of a single-colored print cartridge, viewed from the bottom, according to another embodiment of the present invention.

FIG. 10 is a three-dimensional representation of ink-jet cartridge 900 viewed from the bottom, according to another embodiment. Note that the head assembly 104 includes an orifice plate 1010 having a plurality of orifices 1015. Orifices 1015 are communicatively coupled to compartment 910 for receiving ink therefrom through slots in the print head die that includes orifice plate 1010.

Figure 11:
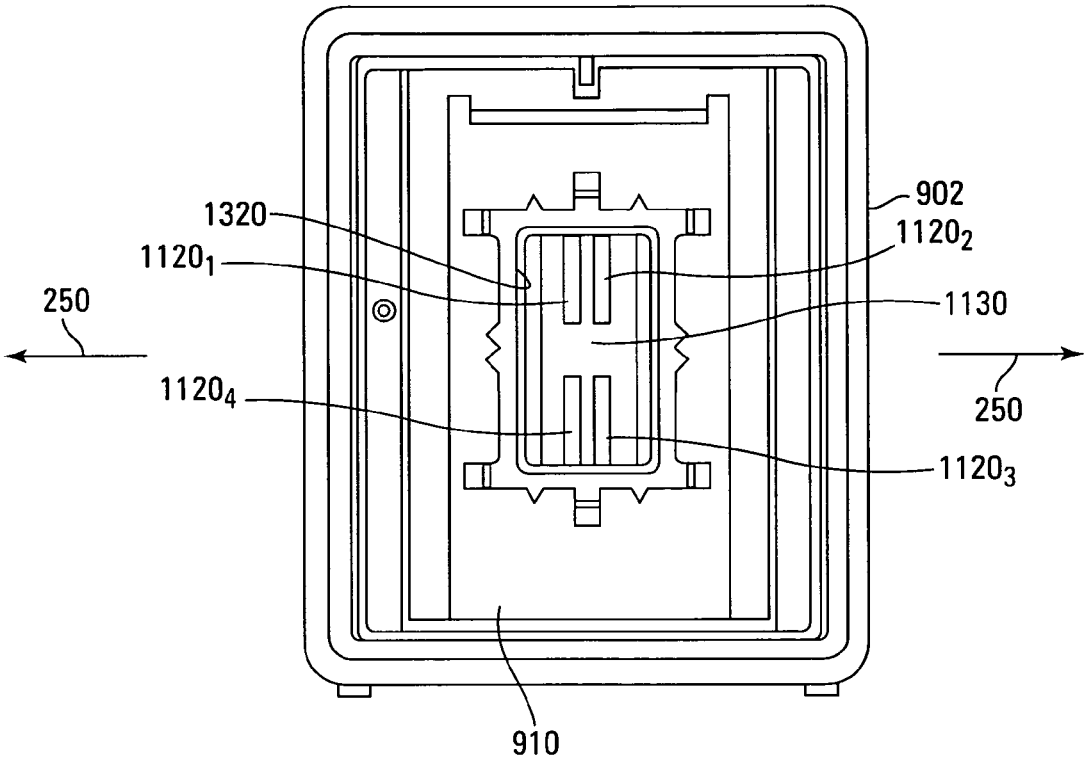
FIG. 11 is a top view of an embodiment of a cartridge body, according to another embodiment of the present invention.
Figure 12:
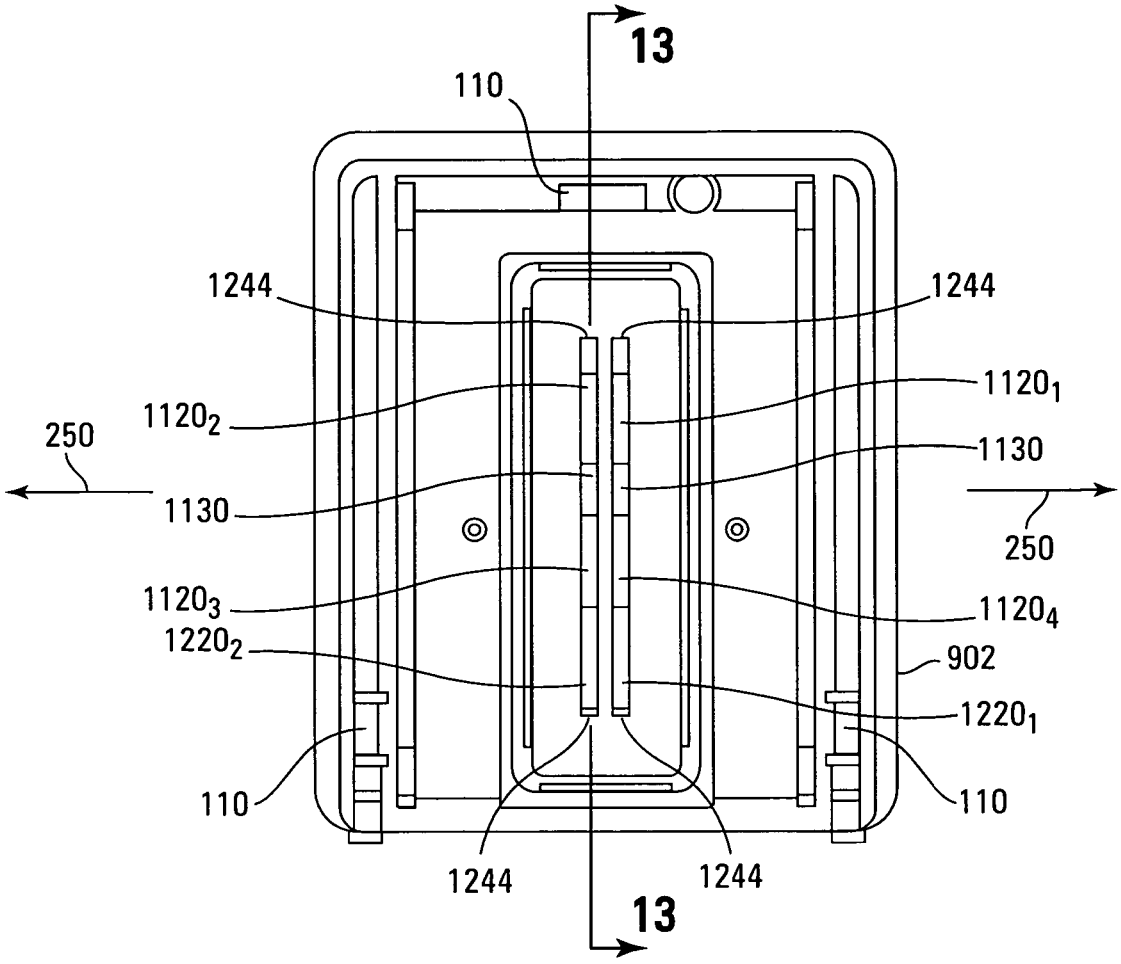
FIG. 12 is a bottom view of an embodiment of a cartridge body, according to another embodiment of the present invention.

FIG. 11 is a top view of cartridge body 902, according to another embodiment. Outlet ports $1120_1$-$1120_4$ are formed at the bottom of compartment 910. For one embodiment, a capillary medium, bellows or other backpressure generating means may be disposed in compartment 910. FIG. 12 is a bottom view of cartridge body 902, according to another embodiment. Cartridge body 902 includes a pair of ink-feed slots (or channels) 1220 that are communicatively coupled to outlet ports 1120. In other words, outlet ports 1120 open into ink-feed channels 1220. Ink-feed channels 1220 open directly to an exterior of cartridge body 902 and communicatively couple compartments 410 to the exterior of cartridge body 902. Ink-feed channels 1220 are configured to respectively align with slots in the print head die on which orifice plate 1110 is mounted for delivering ink thereto. For one embodiment, portions of the bottom of cartridge body 902 surrounding ink-feed channels 1220 are attached directly to portions of the print head die that surround the slots of the print head die, e.g., using an adhesive or encapsulant. In operation, ink flows from compartment 910 (FIGS. 9 and 11), through outlet ports 1120 (FIGS. 11 and 12), into ink-feed channels 1220 (FIG. 12), into the slots of the print head die and subsequently through orifices 1015 (FIG. 10). It should be noted that although generally square or rectangular outlet ports 1120 are shown, they could be other shapes such as circles, slots, etc. Additionally, ink feed channels 1220 could be other shapes, sizes or eliminated altogether, as discussed above in conjunction with FIG. 5.

Note that a web 1130 is formed between the pair of outlet ports $1120_1$ and $1120_2$ and the pair of outlet ports $1120_3$ and $1120_4$ and extends in a direction from the pair of outlet ports $1120_1$ and $1120_2$ to the pair of outlet ports $1120_3$ and $1120_4$ in a direction perpendicular to the scanning direction 250, as shown in FIGS. 11 and 12.

Figure 13:
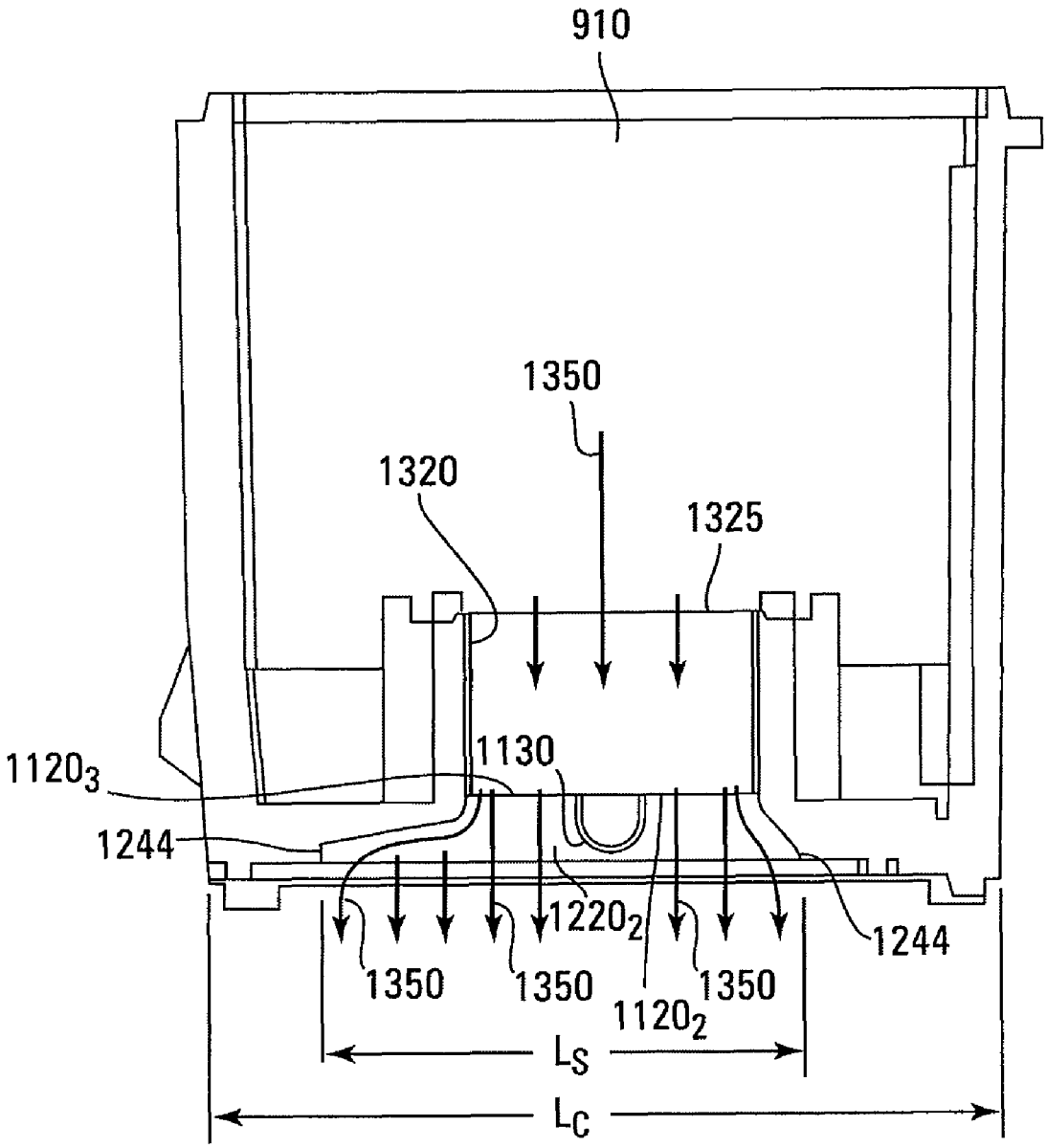
FIG. 13 is a cross-sectional view taken along line 13-13 of FIG. 12, according to another embodiment of the present invention.

FIG. 13 is a cross-sectional view taken along line 13-13 of FIG. 12, according to another embodiment. In one embodiment a duct (or standpipe) 1320 is located within compartment 910 is connected (or opens) to outlet ports $1120_1$-$1120_4$ (see FIG. 11). Outlet ports $1120_2$ and $1120_3$ are shown opening into ink-feed channel $1220_2$ in FIG. 13. Note that outlet ports 1120 may be located away from and between ends 1244 of feed channels 1220 for one embodiment. For another embodiment, a filter may be located over an inlet 1325 of duct 1320. For one embodiment, the capillary material overlies the filter. The ratio of the length $L_C$ of the cartridge body perpendicular to the scanning direction, perpendicular to the plane of FIG. 13, to a length $L_S$ of ink-feed channel $1220_2$ and/or a length of slots of a print head die perpendicular to the scanning direction is less than about 2.

Arrows 1350 (FIG. 13) illustrate a flow path of ink from compartment 910 through duct 1320, through outlet ports $1120_2$ and $1120_3$, and into ink-feed channel $1220_2$. The ink-flow exits outlet ports $1120_2$ and $1120_3$ substantially vertically downward on either side of web 1130 and fills ink-feed channel $1220_2$. Note that a portion of the ink-flow expands to fill ink-feed channel $1220_2$ as it exits outlet ports $1120_2$ and $1120_3$. Note that the cartridge body 902 and ink-feed channels 1220 thereof are formed as single-piece and form a unitary structure. Attaching a print head nozzle array, such the print head die that includes orifice plate 1010 (FIG. 10), seals ink-feed channels 1220 to the corresponding slots in the print head die.

Figure 14:
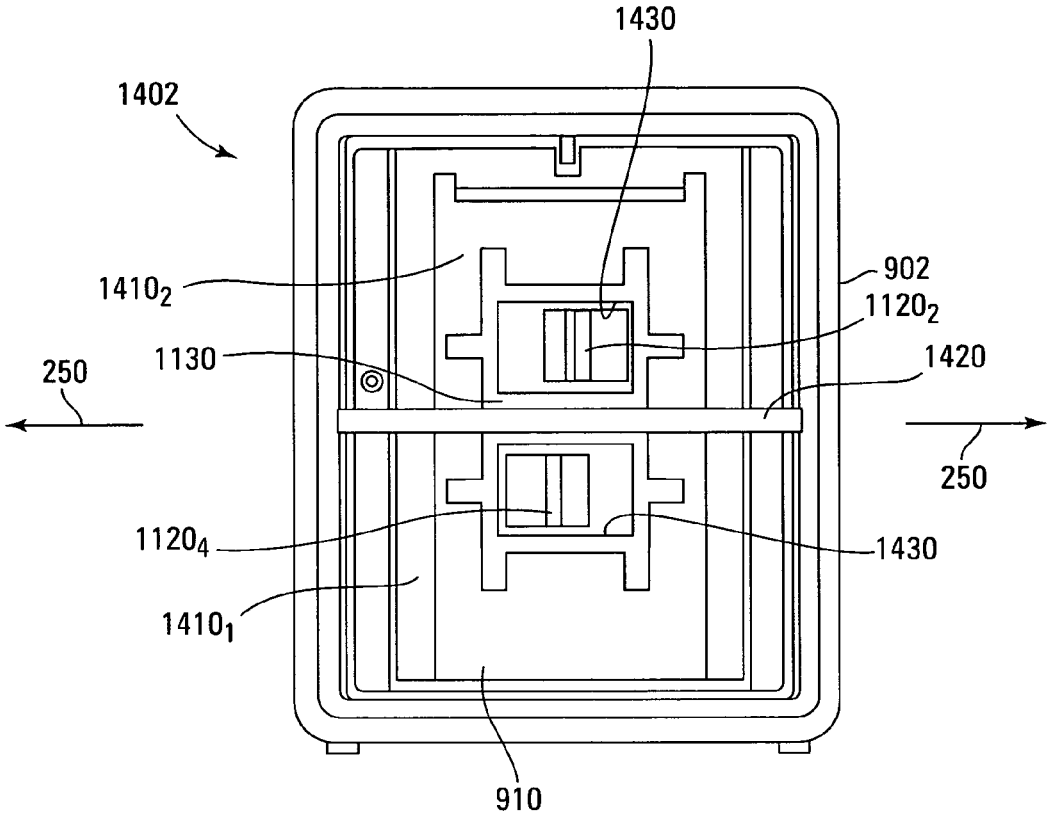
FIG. 14 is a top view of an embodiment of a single-color, two-compartment cartridge body, according to another embodiment of the present invention.

FIG. 14 is a top view of a two-color, two-compartment ink-jet cartridge 1402, according to another embodiment. Common reference numbers denote similar elements in FIGS. 9 and 14. For one embodiment, dividing the compartment 910 (FIG. 11), by forming a partition 1420 on web 1130, forms two compartments 1410 within ink-jet cartridge 1402 that are generally equal in volume. For another embodiment, outlet ports $1120_2$ and $1120_4$ and the web 1130 formed therebetween may be positioned such that the volume of compartments 1410 are respectively different fractions, e.g., about ⅓ and ⅔ (or the volume of one compartments 1410 is about ½ the volume of the other), of the volume of compartment 910. As such, cover 106 (FIG. 1) may be used to close compartments 1410. Moreover, for one embodiment, essentially the same molding process used for cartridge body 902 (FIG. 9), but with a different mold core for forming the interior, may form ink-jet cartridge 1402. For one embodiment, a capillary medium, bellows or other backpressure generating means may be disposed in each of compartment 1410. For other embodiments, compartments 1410 have substantially equal volumes.

Ink-jet cartridge 1402 includes a pair of ink-feed channels (not shown) that for one embodiment may be similar to ink-feed channels 1220 of FIG. 12 or ink-feed channels 520 of FIG. 5. The ink-feed channels are communicatively coupled to outlet ports 1120, as described above. The ink-feed channels open directly to an exterior of ink-jet cartridge 1402 and communicatively couple compartments 1410 to the exterior of ink-jet cartridge 1402. The ink-feed channels are configured to respectively align with slots in a print head die on which an orifice plate is mounted for delivering ink thereto. For one embodiment, portions of the bottom of ink-jet cartridge 1402 surrounding the ink-feed channels are attached directly to portions of the print head die, e.g., using an adhesive or encapsulant. In operation, ink flows from compartment 1410, through outlet ports 1120, into the ink-feed channels, into the slots of the print head die, and subsequently through orifices of the orifice plate. For one embodiment, the ink-flow is substantially similar to the ink-flow depicted by arrows 1350 in FIG. 13 or the ink-flow depicted by arrows 650 and 750 in FIGS. 6 and 7. In one embodiment, a duct (or standpipe) 1430 is located within each compartment 1410 and is connected (or opens) to an outlet port 1120.

It should be noted that the various embodiments of a cartridge disclosed herein do not require plugs for plugging mold-slide-insert access holes and thus act to reduce manufacturing costs.

CONCLUSION

Although specific embodiments have been illustrated and described herein it is manifestly intended that the scope of the claimed subject matter be limited only by the following claims and equivalents thereof.

What is claimed is:

1. A print cartridge body, comprising:

first, second, and third compartments, the second compartment interposed between the first and third compartments;

a partition located between the first and second compartments and a partition located between the second and third compartments; and first, second, and third ink-feed channels respectively opening to an exterior of the cartridge body and respectively communicatively coupling the first, second, and third compartments to the exterior of the cartridge body, the second ink-feed channel interposed between the first and third ink-feed channels;

wherein a portion of the first ink-feed channel is located vertically under the second compartment and another portion of the first ink-feed channel is located vertically under the first compartment, the portion of the first ink-feed channel located vertically under the first compartment allowing a portion of the ink from the first compartment to flow vertically downward from an interior of the first compartment to the exterior of the cartridge body; and wherein a portion of the second ink-feed channel is located vertically under the first compartment and another portion of the second ink-feed channel is located vertically under the second compartment, the portion of the second ink-feed channel located vertically under the second compartment allowing a portion of the ink from the second compartment to flow vertically downward from an interior of the second compartment to the exterior of the cartridge body.

2. The print cartridge body of claim 1, wherein each partition is substantially parallel to a scanning direction of the print cartridge body and extends in a direction substantially parallel to a scanning direction of the cartridge body from a sidewall of the print cartridge to an opposing sidewall of the print cartridge.

3. The print cartridge body of claim 1, wherein a bottom of the exterior of the print cartridge body is substantially a single plane.

4. The print cartridge body of claim 1, wherein the first, second, and third ink-feed channels each have a length in a direction perpendicular to a scanning direction of the print cartridge body that is greater than about ½ of a length of the print cartridge body in the direction perpendicular to the scanning direction of the print cartridge body.

5. A print cartridge body, comprising:

a partition that divides an interior of the body into first and second compartments, each having an outlet port;

a first channel communicatively coupled to the first compartment through the outlet port of the first compartment, the first channel opening to an exterior of the print cartridge body through a first opening in a bottom exterior surface of the print cartridge body;

a second channel communicatively coupled to the second compartment through the outlet port of the second compartment, the second channel opening to the exterior of the print cartridge body through a second opening in the bottom exterior surface of the print cartridge body;

wherein the outlet port of the first compartment is located vertically above and is vertically aligned with the first opening in the bottom exterior surface of the print cartridge body, the direct vertical alignment between the outlet port of the first compartment and the first opening in the bottom exterior surface of the print cartridge body allowing a portion of an ink flow from an interior of the first compartment to flow vertically downward from the interior of the first compartment into the first channel, vertically downward through the first channel to the first opening in the bottom exterior surface of the print cartridge body, and vertically downward through the first opening in the bottom exterior surface of the print cartridge body; and wherein the outlet port of the second compartment is located vertically above and is vertically aligned with the second opening in the bottom exterior surface of the print cartridge body, the direct vertical alignment between the outlet port of the second compartment and the second opening in the bottom exterior surface of the print cartridge body allowing a portion of an ink flow from an interior of the second compartment to flow vertically downward from the interior of the second compartment into the second channel, vertically downward through the second channel to the second opening in the bottom exterior surface of the print cartridge body, and vertically downward though the second opening in the bottom exterior surface of the print cartridge body.

6. The print cartridge body of claim 5, wherein a volume of the first compartment is less than a volume of the second compartment, volumes of the first and second compartments are substantially equal, or the volume of the first compartment is about ½ the volume of the second compartment.

7. The print cartridge body of claim 5, wherein the first and second openings in the bottom exterior surface have a length in a direction perpendicular to a scanning direction of the print cartridge body that is greater than about ½ of a length of the print cartridge body in the direction perpendicular to the scanning direction of the print cartridge body.

8. The print cartridge body of claim 5, wherein the bottom exterior surface of the print cartridge body is substantially a single plane and is not stepped.

9. A print cartridge, comprising:

a print head; and a body, wherein the body comprises:

three or more compartments in series, the three or more compartments respectively communicatively coupled to the print head; and a partition formed between each successive pair of compartments;

wherein each partition is substantially parallel to a scanning direction of the print cartridge and extends in a direction substantially parallel to the scanning direction of the print cartridge from a sidewall of the print cartridge to an opposing sidewall of the print cartridge; and wherein a bottom exterior surface of the print cartridge is substantially a single plane and is not stepped.

10. The print cartridge of claim 9, wherein three or more outlet ports respectively of the three or more compartments respectively open directly into three or more ink-feed channels, the three or more ink-feed channels respectively configured to open directly into three or more ink-feed slots in the print head.

11. The print cartridge of claim 10, wherein a normal to a plane of at least one of the three or more outlet ports is oriented at an angle to vertical.

12. The print cartridge of claim 11, wherein at least one of the three or more outlet ports opens into its respective ink-feed channel away from ends of that ink-feed channel.

13. The print cartridge of claim 9, wherein the three or more ink-feed channels respectively have a length in a direction perpendicular to the scanning direction of the print cartridge that is greater than about ½ of a length of the print cartridge in the direction perpendicular to the scanning direction of the print cartridge.

14. The print cartridge of claim 9, wherein three or more outlet ports respectively of the three or more compartments respectively open directly into three or more ink-feed slots in the print head.

15. A method for delivering ink to a print head of a print cartridge, the method comprising:

respectively directing first, second, and third ink flows from first, second, and third compartments of the print cartridge through first, second, and third channels into first, second, and third slots of the print head, the second compartment interposed between the first and third compartments, the second channel interposed between the first and third channels;

wherein a portion of the first ink flow flows vertically downward from an interior of the first compartment through the first channel and into the first slot of the print head and another portion of the first ink flow flows within the first channel directly under the second compartment and subsequently flows vertically downward into the first slot of the print head from a location directly under the second compartment; and wherein a portion of the second ink flow flows vertically downward from an interior of the second compartment through the second channel and into the second slot of the print head and another portion of the second ink flow flows within the second channel directly under the first compartment and subsequently flows vertically downward into the second slot of the print head from a location directly under the first compartment.

16. The method of claim 15, wherein the third ink flow enters the third channel from the third compartment at an angle to vertical and the scanning direction, a portion of the third ink flow flowing substantially horizontally directly under the first and second compartments and subsequently flowing vertically downward into the third slot of the print head from locations directly under the first and second compartments.

17. The method of claim 15, wherein the first, second, and third slots of the print head have a length in a direction perpendicular to the scanning direction of the print cartridge that is greater than about ½ of a length of the print cartridge in the direction perpendicular to the scanning direction of the print cartridge.

18. A method for delivering ink to a print head of a print cartridge, the method comprising:

directing a first ink flow from a first compartment of the print cartridge through an outlet port of the first compartment and into a first channel communicatively coupled to the first compartment through the outlet port of the first compartment;

directing a second ink flow from a second compartment of the print cartridge through an outlet port of the second compartment and into a second channel communicatively coupled to the second compartment through the outlet port of the second compartment;

respectively directing the first and second ink flows through the first and second channels and into first and second slots of a print head that are respectively communicatively coupled to and aligned with the first and second channels;

wherein the outlet port of the first compartment and the outlet port of the second compartment are respectively aligned with the first and second channels and thus with the first and second slots of the print head;

wherein a portion of the first ink flow flows vertically downward from the first outlet port into the first channel and vertically downward through the first channel into the first slot of the print head; and wherein a portion of the second ink flow flows vertically downward from the second outlet port into the second channel and vertically downward through the second channel into the second slot of the print head.

19. The method of claim 18, wherein a partition formed between the first and second compartments is substantially parallel to a scanning direction of the print cartridge and extends in a direction substantially parallel to the scanning direction of the print cartridge from a sidewall of the print cartridge to an opposing sidewall of the print cartridge, wherein a bottom of an exterior of the print cartridge is substantially a single plane and is not stepped.

20. The method of claim 18, wherein each of the first and second slots of the print head have a length in a direction perpendicular to the scanning direction of the print cartridge that is greater than about ½ of a length of the print cartridge in the direction perpendicular to the scanning direction of the print cartridge.

* * * * *

UNITED STATES PATENT AND TRADEMARK OFFICE

CERTIFICATE OF CORRECTION

PATENT NO. : 7,712,883 B2
APPLICATION NO. : 11/493336
DATED : May 11, 2010
INVENTOR(S) : Anthony D. Studer It is certified that error appears in the above-identified patent and that said Letters Patent is hereby corrected as shown below:

In column 1, line 14, delete "j et" and insert -- jet --, therefor.
In column 8, line 34, in Claim 5, delete "though" and insert -- through --, therefor.

Signed and Sealed this

Twenty-eighth Day of September, 2010

David J. Kappos

David J. Kappos
*Director of the United States Patent and Trademark Office*